US005673580A

United States Patent [19]

Ohno

[11] Patent Number: 5,673,580

[45] Date of Patent: Oct. 7, 1997

[54] BURRING PROCESSING METHOD, JIG FOR BURRING PROCESSING, AND BURRING PROCESSING APPARATUS

[75] Inventor: Yoshio Ohno, Tokyo, Japan

[73] Assignee: Daitoh Inc., Tokyo, Japan

[21] Appl. No.: 582,302

[22] Filed: Jan. 3, 1996

[30] Foreign Application Priority Data

Jan. 26, 1995 [JP] Japan ..... 7-010256

[51] Int. Cl.[6] ..... B21D 28/28

[52] U.S. Cl. ..... 72/70; 72/75

[58] Field of Search ..... 72/70, 75, 370; 29/890.148

[56] References Cited

U.S. PATENT DOCUMENTS

| | | | |
|---|---|---|---|
| 691,454 | 1/1902 | Dies | 29/890.148 |
| 3,154,130 | 10/1964 | Streeter | 72/70 |

FOREIGN PATENT DOCUMENTS

| | | | |
|---|---|---|---|
| 597451 | 8/1959 | Italy | 72/75 |
| 57-41830 | 3/1982 | Japan | 72/75 |
| 6-38574 | 10/1994 | Japan . | |

*Primary Examiner*—Lowell A. Larson

*Attorney, Agent, or Firm*—Kanesaka & Takeuchi

[57] ABSTRACT

A burring processing method for performing burring processing for a metallic pipe 90 within a short time to provide a beautifully finished appearance. A jig with an inclined section 15 is inserted into the inside of the metallic pipe 90 with a prepared hole 91. After the jig and the metallic pipe 90 are fixed in a state that the inclined section 15 of the jig is aligned with the prepared hole 91, steel balls 41 having a diameter greater than that of the prepared hole 91 are pressed against the inclined section 15 inside the metallic pipe 90 so that the steel ball 41 is pushed from under the prepared hole 91 to the outside of the metallic pipe 90.

8 Claims, 9 Drawing Sheets

BURRING PROCESSING METHOD, JIG FOR BURRING PROCESSING, AND BURRING PROCESSING APPARATUS

BACKGROUND OF THE INVENTION

1. Field of the Invention

The present invention relates to a burring processing for boring holes for connections of branch pipes to a long metallic pipe (conduit) and further for forming overhanging portions around the bored holes.

2. Background of the invention and the Related Art Statement

Recently, there has been known a so-called burring processing which is available in attaching branch pipes 97 to such a long metallic pipe 90 as a copper pipe, aluminium pipe and steel pipe as shown in FIG. 8.

The burring processing is a way of boring prepared holes in the metallic pipe 90 by means of a drill or the like, pulling out the circumferential sections of the prepared holes to make overhanging sections 93 and hence to enlarge the diameters of the prepared holes to finally create insertion holes corresponding to the outer diameters of the branch pipes 97.

The metallic pipe 90 burring-processed can contribute stronger connections with the branch pipes 97 through the overhanging sections 93, thus accomplishing firmer connection and fixing of the branch pipes 97 in cooperation with welding sections 99.

In many cases, this burring processing uses a special drill unit containing invisible blades 107 located at the vicinity of a drill 105 as shown in FIG. 9, and these invisible blades 107 are housed inside the drill 105 when the drill unit bores holes 91 whereas the blades 107 protrudes from the circumference of the drill 105 when the drill unit rotates the drill 105 in the reverse direction to lift it, thereby raising the section around the prepared hole 91 together. Thus, the invisible blades 107 of the special drill unit bends up the section around the prepared hole 91 to produce an overhanging section 93.

Moreover, another burring processing is, as exemplified by Japanese Published Examined Utility Model Gazette No. 6-38574, such that as shown in FIG. 10 a prepared hole 91 is made in advance in a metallic pipe 90 and a drawing die 113 having a conical trapezoid configuration or the like is inserted into the metallic pipe 90 using an inserting device 115 to reach a position under the prepared hole 91 and subsequently a tip portion of a drawing rod 111 is inserted through the prepared hole 91 into the inside of the metallic pipe 90 to engage with the drawing die 113 and the drawing rod 111 is lifted while the section around the prepared hole 91 is pressed by a flask, with the result that the section around the prepared hole 91 is bent up to enlarge the prepared hole 91 to form an overhanging section 93 as shown in FIG. 11 which serves as an insertion hole 95 for accepting the branch pipe 97.

There are problems which arises with such a way of raising the section around the prepared hole by eccentric rotation of the drill or raising it with the invisible blades by the reverse rotation of the special drill as mentioned before, however, in that many burr and frictional damages occur in the overhanging section and hence the soldering material flows from the soldering portion in soldering or brazing of the branch pipe to make it difficult to provide a beautifully finished appearance and further to make it difficult to certainly connect the branch pipe to the long metallic pipe, besides it takes much time and trouble to form one hole and an overhanging section therearound in the metallic pipe according to the burring processing.

In addition, in the case of a way of disposing the drawing die inside the metallic pipe and of inserting the drawing rod through the prepared hole to then raise the drawing die, difficulty is experienced to accurately align the drawing die with the positions of the prepared hole and the drawing rod, and it is troublesome to make the connection of the drawing rod with the drawing die, which results in requiring much time for producing one burring-processed hole together with the overhanging section.

SUMMARY OF THE INVENTION

In accordance with the present invention, there is provided a burring processing method in which a jig (tool) with an inclined section is inserted into and disposed in the inside of a metallic pipe with prepared holes, and the jig and the metallic pipe are fixed in a state that the inclined section of the jig is aligned with the prepared hole and a steel ball with a diameter greater than that of the prepared hole is pressed against the inclined section thereof inside the metallic pipe and subsequently the steel ball is pushed from under the prepared hole to the outside of the metallic pipe.

In addition, in accordance with this invention, a jig with a punching hole and an inclined section is inserted into and set in a metallic pipe and a tip portion of a punch is driven in the punching hole to make a prepared hole in a side surface of the metallic pipe, and subsequently a steel ball is pressed against the inclined section of the jig in a state that the prepared hole is aligned with the inclined section thereof so that the steel ball with a diameter larger than that of the prepared hole is pushed from under the prepared hole toward the outside of the metallic pipe to enlarge the diameter of the prepared hole, thus creating an overhanging section around the prepared hole.

Furthermore, in accordance with this invention, for the burring processing there is used a jig equipped with a core metal body having an elongated cylindrical rod configuration and having therein a rod hole which linearly extends to define an opening in a proximal side end portion of the core metal body while being curved at the vicinity of a tip portion of the core metal body to define an opening in a side surface of the core metal body, and further provided with a rod bar coupled to a piston disposed near the proximal portion of the core metal body and situated within the rod hole, and still further provided with a plurality of steel balls housed within the rod hole while positioned at the tip portion of the rod bar.

This burring processing jig can incorporate a punching hole formed at a position closer to the tip portion of the core metal body than the position of the opening of the rod hole to stand side by side with the opening so that its axis of the punching hole is perpendicular to the axis of the core metal body.

Moreover, there is provided a burring processing apparatus which includes a metal pattern comprising a fixed lower pattern and a movable upper pattern, the lower pattern having a semi-cylindrical groove section suiting the outer diameter of a metallic pipe made in its faying surface and the upper pattern having a semi-cylindrical groove section matching the same metallic pipe made in its faying surface, and the upper pattern having a punching through-hole extending from the upper pattern groove section to the top surface of the upper pattern and further having a guide hole similarly penetrating the upper pattern with a diameter larger than that of the punching through-hole, and a tip portion of a cylindrical bar-like jig suiting the metallic pipe being disposed inside the lower pattern groove section and an inclined section of the jig being positioned under the guide hole and a punching hole of the jig being positioned under the punching through-hole, and further which includes a rod bar movable forward and backward by a combination of a piston and a cylinder and provided so that its axis is aligned with the axis of the jig, and still further includes a punch sliding in the punching through-hole of the upper pattern and a steel ball returning pin located within the guide hole of the upper pattern and movable up and down.

The jig to be used in this burring processing apparatus is equipped therein with a rod hole which linearly extends to establish or produce an opening in a proximal side end portion of the core metal body while being curved at the vicinity of a tip portion of the core metal body to establish an opening in a side surface of the core metal body, and further provided with a rod bar coupled to a piston disposed near the proximal portion of the core metal body and situated within the rod hole, and still further provided with a plurality of steel balls housed within the rod hole while positioned at the tip portion of the rod bar.

The jig can be provided with a punching hole formed at a position closer to the tip portion of the core metal body than the position of the opening of the rod hole to stand side by side with the opening so that its axis is perpendicular to the axis of the core metal body.

In accordance with this invention, since there is provided a method in which the jig with the inclined section is inserted into a metallic pipe to be disposed and fixed therein and the steel ball is pressed against the inclined section aligned with a prepared hole, the steel ball with a diameter larger than that of the prepared hole can be held through the inclined section against the prepared hole from the inside of the metallic pipe and the section around the prepared hole can be raised by the steel ball to enlarge the diameter of the prepared hole.

In addition, according to the method in which the jig with the punching hole and the inclined section is inserted into a metallic pipe to be disposed therein and a hole is made by the punching processing and the steel ball is pressed against the inclined section in a state that the prepared hole is aligned with the position of the inclined section so as to enlarge the prepared hole, the prepared hole can quickly be formed by the punching processing and, in such a way that the steel ball with a diameter greater than that of the prepared hole is pushed out through the prepared hole, the section around the prepared hole can easily be raised to form an overhanging section.

Furthermore, in the case of the jig equipped with the rod hole which linearly extends in the bar-like core metal body and the tip portion of which is then curved to make an opening in a side surface of the core metal body, when the core metal body is inserted into a metallic pipe, the opening section of the rod hole can readily take a given position in the metallic pipe, and further the rod bar provided within the rod hole can be slid axially by means of the piston so that the steel ball can strongly be pressed against a given position of the metallic pipe from the inside of the metallic pipe in such a manner that the steel ball situated on the tip portion of the rod bar are pushed out through the opening section.

Moreover, in the case of the jig further having the punching hole arranged side by side with the opening section of the rod hole, with this jig being inserted into the inside of a metallic pipe, a hole can readily be made in the metallic pipe by the punching processing, and the steel ball can strongly be pressed against the inside of the metallic pipe in such a manner that the steel ball is pushed out through the opening section of the rod hole.

Furthermore, in the case of the apparatus including the metal pattern, the punch and the jig, since the metal pattern has the semi-cylindrical upper and lower pattern groove sections made in the faying surfaces, a metallic pipe can be sandwiched and fixed from the external portions by the upper and lower patterns; a hole can easily be made in the metallic pipe fixed in the groove sections by means of the punch slidable in the punching through-hole of the upper pattern and using the rod bar; the steel ball can be pressed against the inclined section of the jig; the tip portion of which is disposed in the inside of the groove sections; and further the steel ball can surely be returned to the inside of the metallic pipe by means of the steel ball returning pin positioned in the guide hole.

Still further, in the case of the apparatus equipped with the jig having the rod bar and the steel ball in the rod hole, the metal pattern, the punch and others, the burring processing can quickly be accomplished by inserting the jig in a metallic pipe so that the jig is covered with the metallic pipe, fixing the metallic pipe with the metal pattern, making a prepared hole in the metallic pipe by the punch, and pressing the steel ball of the jig against the metallic pipe.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF PREFERRED EMBODIMENTS

Figure 1:
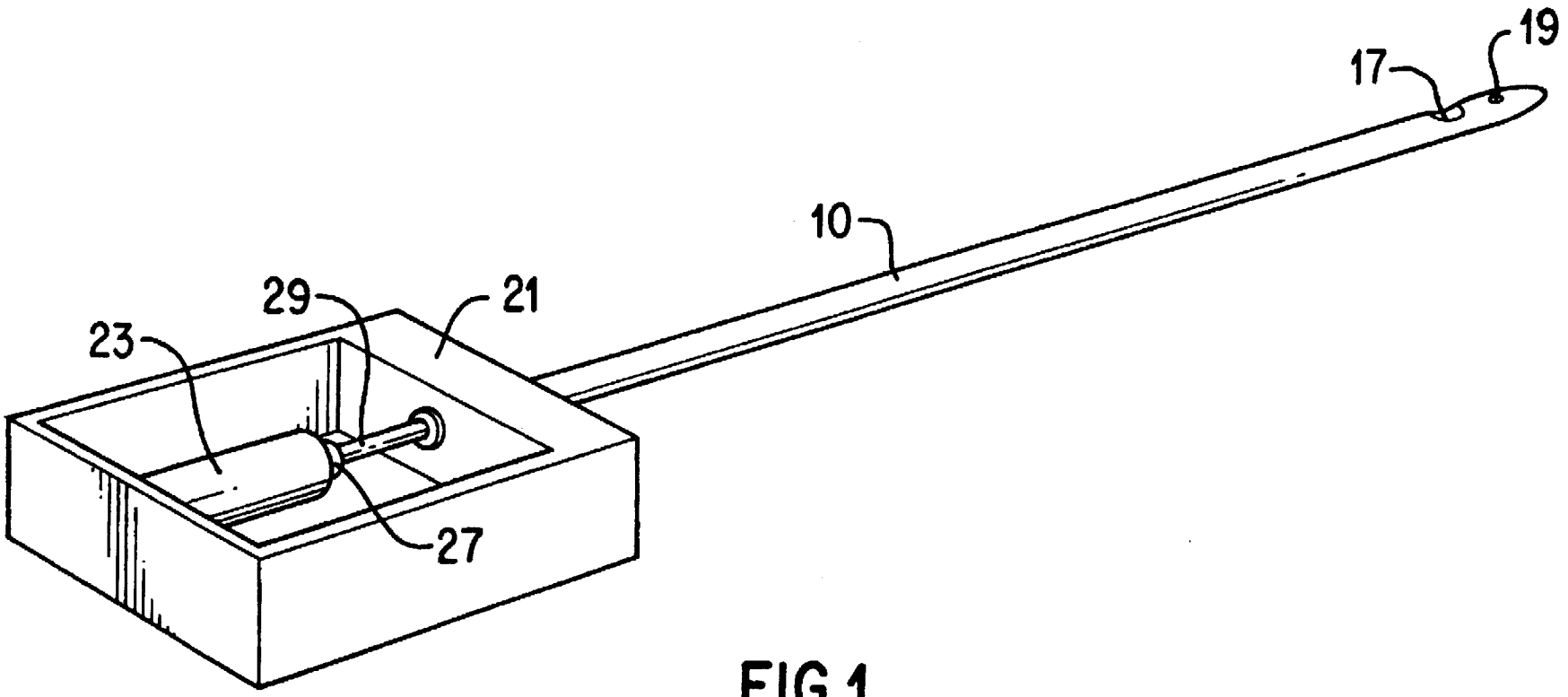
FIG. 1 is a perspective view showing a jig for burring processing according to the present invention.

A burring processing according to an embodiment of the present invention uses a jig based upon a combination of an elongated cylindrical bar-like core metal and a piston as shown in FIG. 1.

In this jig, a proximal, or base, section of an elongated bar-like core metal body 10 is fixed onto a core metal supporting pedestal 21 and further a piston cylinder 23 is also fixed thereonto.

Figure 2:
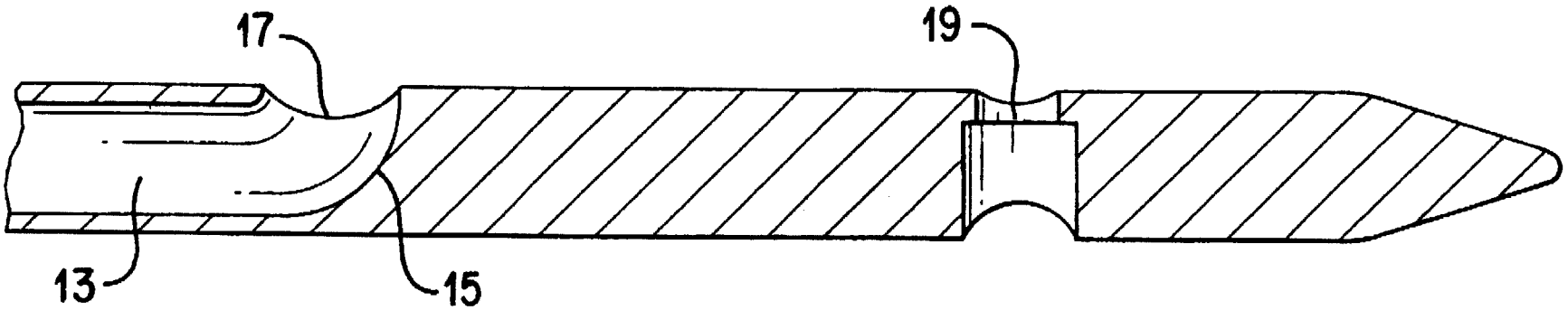
FIG. 2 is a cross-sectional view showing a principal section of the burring processing jig according to this invention.
Figure 3:
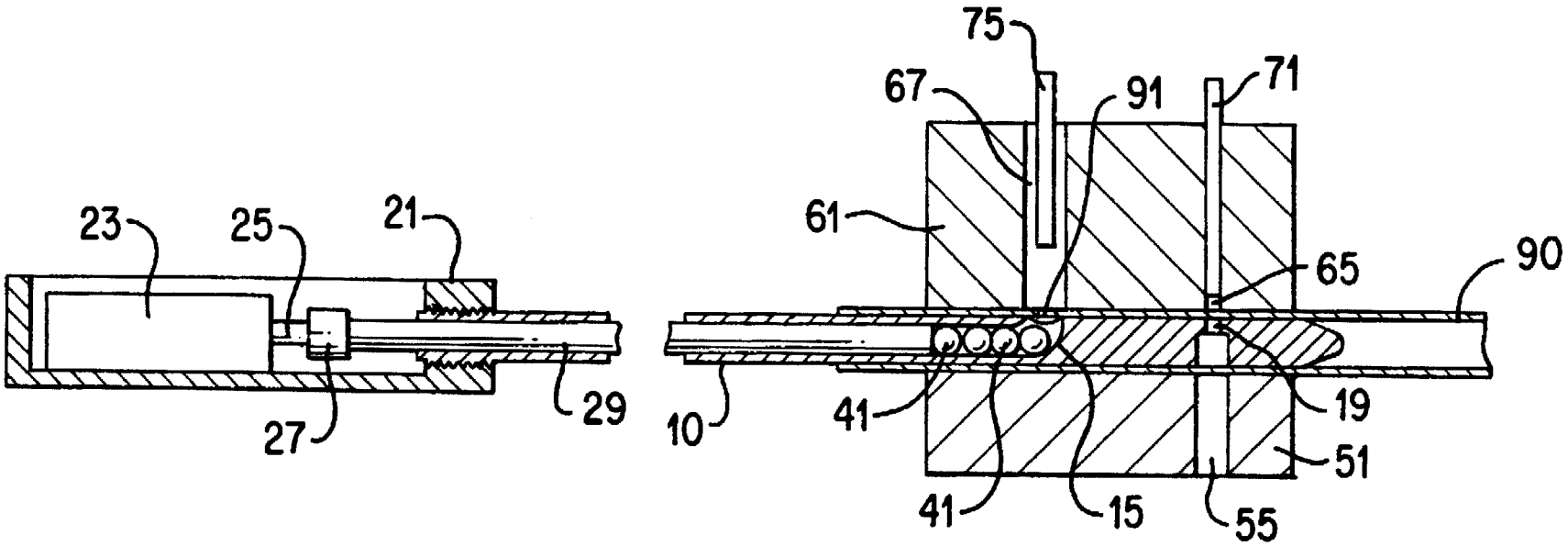
FIG. 3 is a cross-sectional view showing a state in use of the burring processing jig according to this invention.

Inside the core metal body 10, as shown in FIGS. 2 and 3 a rod hole 13 is formed to linearly extend from the proximal side end of the core metal body 10 up to the vicinity of the tip portion thereof along the center line or axis of the core metal body 10.

The tip portion of this rod hole 13 is curved to establish an opening section 17 in a side surface of the core metal body 10 and further to define an inclined section 15 in the opening section 17.

In addition, the inside of the rod hole 13 accepts a rod bar 29 whose proximal portion is coupled through a joint 27 to a piston rod 25, and additionally accommodates a plurality of steel balls 41 at the tip portion of the rod bar 29 so that the steel balls 41 can be extruded through the opening section 17 of the rod hole 13 in response to the forward and backward movements of the piston rod 25.

Further, the core metal body 10 has a punching hole 19 made at a position closer to its tip portion than the opening section 17 of the rod hole 13 to establish an opening in the same direction as that of the opening section 17 of the rod hole 13 so that its axis is perpendicular to the axis of the core metal body 10.

Thus, the jig according to this embodiment is of the type that the rod bar 29 and the steel balls 41 are accommodated within the core metal body 10 and the steel balls 41 are extruded through the opening section 17 of the rod hole 13 by the movements of the piston. Accordingly, as shown in FIG. 3 the jig is inserted and disposed in a metallic pipe 90 in such a manner that the core metal body 10 is covered with the metallic pipe 90 and the metallic pipe 90 and the jig are fixed in a state that a prepared hole 91 of the metallic pipe 90 is positioned at the opening section 17.

In this state, when a pressurized oil is fed into the piston cylinder 23 so that the rod bar 29 advances to cause the steel balls 41 to be pressed against the inclined section 15, the steel balls 41 are extruded through the opening section 17 of the core metal body 10 while being strongly pressed against metallic pipe 90 from the inside thereof at the position of the prepared hole 91, with the result that the peripheral section of the prepared hole 91 is raised to enlarge the diameter of the prepared hole 91.

In this embodiment, in pressing the steel balls 41 against the position of the prepared hole 91 from the inside of the metallic pipe 90 using such a jig, as shown in FIG. 3 the metallic pipe 90 is fixed from the upside and downside by means of the lower pattern 51 and the upper pattern 61.

Figure 4:
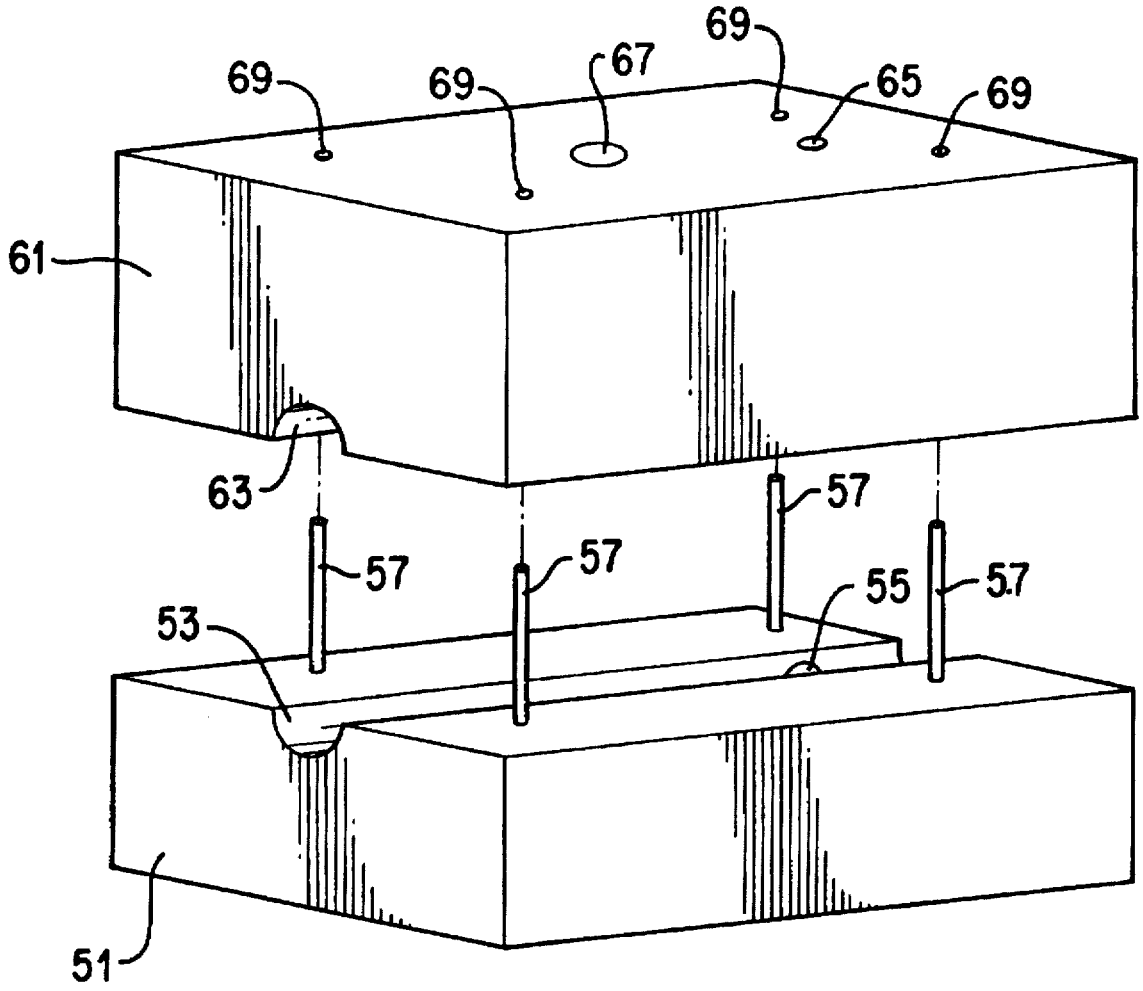
FIG. 4 is a perspective view showing a metal pattern to be used in a burring processing apparatus according to this invention.

This metal pattern, as shown in FIG. 4, is composed of the lower pattern 51 having a semi-cylindrical groove section 53 in its faying surface and the upper pattern 61 also having a semi-cylindrical groove section 63 in its faying surface.

When the upper and low patterns 61, 51 are combined with each other, the lower pattern groove section 53 made in the faying surface of the lower pattern 51 and the upper pattern groove section 63 made in the faying surface of the upper pattern 61 define a cylindrical space with a diameter substantially agreeing with the outer diameter of the metallic pipe 90.

Further, the lower pattern 51 has a discharge hole 55 extending from the lower pattern groove section 53 up to the bottom surface of the lower pattern 51. In addition, positioning pins 57 are adequately formed in the faying surface of the lower pattern 51, while the upper pattern 61 has a punching through hole 65 and a guide hole 67 which extend from the upper pattern groove section 63 up to the top surface of the upper pattern 61, and further has positioning holes 69 for accommodating the positioning pins 57 made on the lower pattern 51.

When the upper pattern 61 and the lower pattern 51 are aligned with each other and piled up in a state that the positioning pins 57 of the lower pattern 51 are inserted into the positioning holes 69 of the upper pattern 61, the discharge hole 55 of the lower pattern 51 is coaxial with the punching through-hole 65 of the upper pattern 61, and the punching through-hole 65 of the upper pattern 61 can slidably or movably accept a punch 71 inserted into a punching hole 19 of the core metal body 10.

Moreover, the distance between the guide hole 67 and the punching through-hole 65 in the upper pattern 61 is made to coincide with the distance between the opening section 17 of the rod hole 13 and the punching hole 19 in the core metal body 10, and the diameter of the guide hole 67 is made to be slightly larger than that of the steel balls 41, while the steel ball returning pin 75 is disposed within the guide hole 67.

More specifically, as shown in FIG. 3 the lower pattern 51 is fixed so that the discharge hole 55 of the lower pattern 51 is aligned with the punching hole 19 of the core metal body 10, and the tip portion of the jig is positioned in the inside of the lower pattern groove section 53 in such a way that the core metal supporting pedestal 21 is fixed in a state that the axis of the core metal body 10 is aligned with the axis of the lower pattern groove section 53, and subsequently the upper pattern 61 is put on the lower pattern 51 while the positioning pins 57 of the lower pattern 51 are inserted into the positioning holes of the upper pattern 61.

The upper pattern 61 is attached to a movable plate, not shown, to produce a movable metal pattern movable up and down. Further, the punch 71 positioned in the punching through-hole 65 of the upper pattern 61 is mounted onto a punch driving apparatus, not shown, and the steel ball returning pin 75 inserted into the guide hole 67 is also mounted onto a returning pin driving apparatus, not shown, so that the punch 71 and the steel ball returning pin 75 become movable in their axial directions.

Accordingly, when the metallic pipe 90 is pushed to cover the core metal body 10 and reaches a given position, the upper pattern 61 is lowered to fix the metallic pipe 90, and the punch 71 is lowered by the punch driving apparatus so that the tip portion of the punch 71 is inserted into the punching hole 19 and is driven, with the result that the prepared hole 91 can be made in the side surface of the metallic pipe 90 with extreme ease. The punch 71 and the upper pattern 61 are lifted while the metallic pipe 90 is moved so that the prepared hole 91 comes to the position of the opening section 17 of the rod hole 13.

Subsequently, the upper pattern is set down to fix the metallic pipe 90, and the pressurized oil is supplied to the piston cylinder 23 so that the rod bar 29 advances to allow the steel balls 41 to be pressed against the inclined section 15 and to be extruded through the opening section 17. If the steel balls 41 are strongly pressed against the metallic pipe 90 from under the prepared hole 91 to be extruded to the outside of the metallic pipe 90, the peripheral section of the prepared hole 91 (the metallic pipe portion around or surrounding the prepared hole 91) are pushed aside into the guide hole 67 of the upper pattern 61 so that the metallic pipe 90 can deform to develop an overhanging section 93.

If the stroke distance of the piston rod 25 is appropriately adjusted, one or two steel balls 41 are pushed out through the rod hole 13 into the guide hole 67, thus accomplishing the burring processing.

Thereafter, when the piston rod 25 and the rod bar 29 are moved to retreat, the steel balls 41 pushed into the guide hole 67 can return to the rod hole 13. Further, when the steel ball returning pin 75 is lowered, the steel balls 41 extruded from the metallic pipe 90 can surely return to the rod hole 13. When the steel ball returning pin 75 and the upper pattern 61 are lifted, the metallic pipe 90 is movable so that the hole preparation processing and burring processing are easily repeatedly possible according to the same procedure.

Furthermore, when the formation of a needed number of insertion holes 95 with the overhanging sections 93 completes, if the metallic pipe 90 is drawn from the core metal body 10 after the lifting of the upper pattern 61, the scraps accumulated under the punching hole 19 drop into the discharge hole 55 of the lower pattern 51.

Thus, in the case of the apparatus including the jig in which the core metal body 10 is provided with the punching hole 19, the rod hole 13 defining the inclined section 15 at its tip portion the rod bar 29 movable forward and backward through the piston and the steel balls 41, and further including the metal pattern, the punch 71 and the steel ball returning pin 75, the metallic pipe 90 is inserted into the lower pattern groove section 53 while covering the core metal body 10, and when reaching a given position, the upper pattern 61 is put down to fix the metallic pipe 90, and subsequently the punch 71 is lowered whereby the hole 91 is instantaneously made in the metallic pipe 90.

Following the formation of the prepared hole 91, the punch 71 and the upper pattern 61 are lifted and then the metallic pipe 90 is moved so that the prepared hole 91 comes to the position of the opening section 17 of the rod hole 13, and then the upper pattern 61 is lowered to fix the metallic pipe 90. Then the hydraulic pressure is supplied into the piston cylinder 23, with the result that the diameter of the prepared hole 91 can quickly be enlarged to form the overhanging section 93 with extreme ease, thus completing the burring processing.

Moreover, according to this burring processing, since the steel balls 41 are strongly raised from under the prepared hole 91 by means of the hydraulic pressure so as to bend the peripheral section of the prepared hole 91, the metallic pipe 90 can be burring-processed to offer a beautiful finish without the occurrence of burrs or the like and, in the soldering or the like, the soldering material can be placed skillfully on the end portion of the overhanging section 93 so that the branch pipes 97 can surely be welded to the metallic pipe 90.

Figure 5:
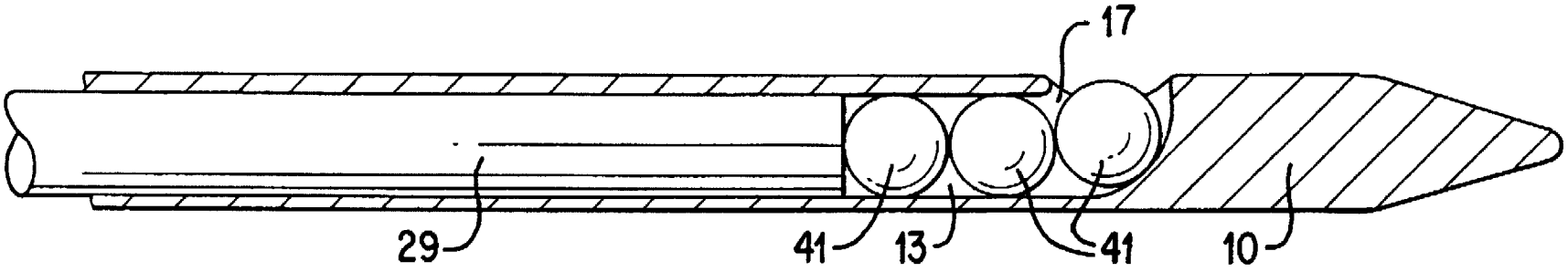
FIG. 5 is a cross-sectional view showing another embodiment of a burring processing jig according to this invention.

Although this embodiment relates to a way in which the burring processing is made to the metallic pipe 90 with no prepared holes, in a case where the burring processing is made to a metallic pipe 90 in which prepared holes 91 are already made using a drill or a punch, as shown in FIG. 5, the jig in which the core metal body 10 having only the rod hole 13 forming the opening section 17 in its side surface is fixed on the core metal supporting pedestal 21 and both the rod bar 29 and plurality of steel balls 41 are inserted into the rod hole 13. The rod bar 29 is moved to advance in a state that the opening section 17, i.e., the inclined section 15, is aligned with the prepared hole 91.

In consequence, the steel balls 41 are pushed out through the opening section 17, thus achieving the burring processing for the formation of the overhanging section 93.

In the jig, preferably the outer diameter of the core metal body 10 is generally equal to the inner diameter of the metallic pipe 90 being processed and naturally the diameter of the prepared hole 91, i.e., the diameter of the punch 71, is determined to match the wall thickness of the metallic pipe 90, and the height of the overhanging section 93 being formed. Further the diameter of the steel balls 41 is determined to suit the outer diameter of the branch pipes 97.

Moreover, although this embodiment relates to the burring processing in which the branch pipes 97 whose dimension is smaller than the inner diameter of the metallic pipe 90 are welded to the metallic pipe 90, if using the jig with the inclined section and the steel balls 41, it is also possible to carry out the burring processing where the branch pipes 97 whose outer diameter is generally equal to the inner diameter of the metallic pipe 90 are welded thereto.

Figure 6:
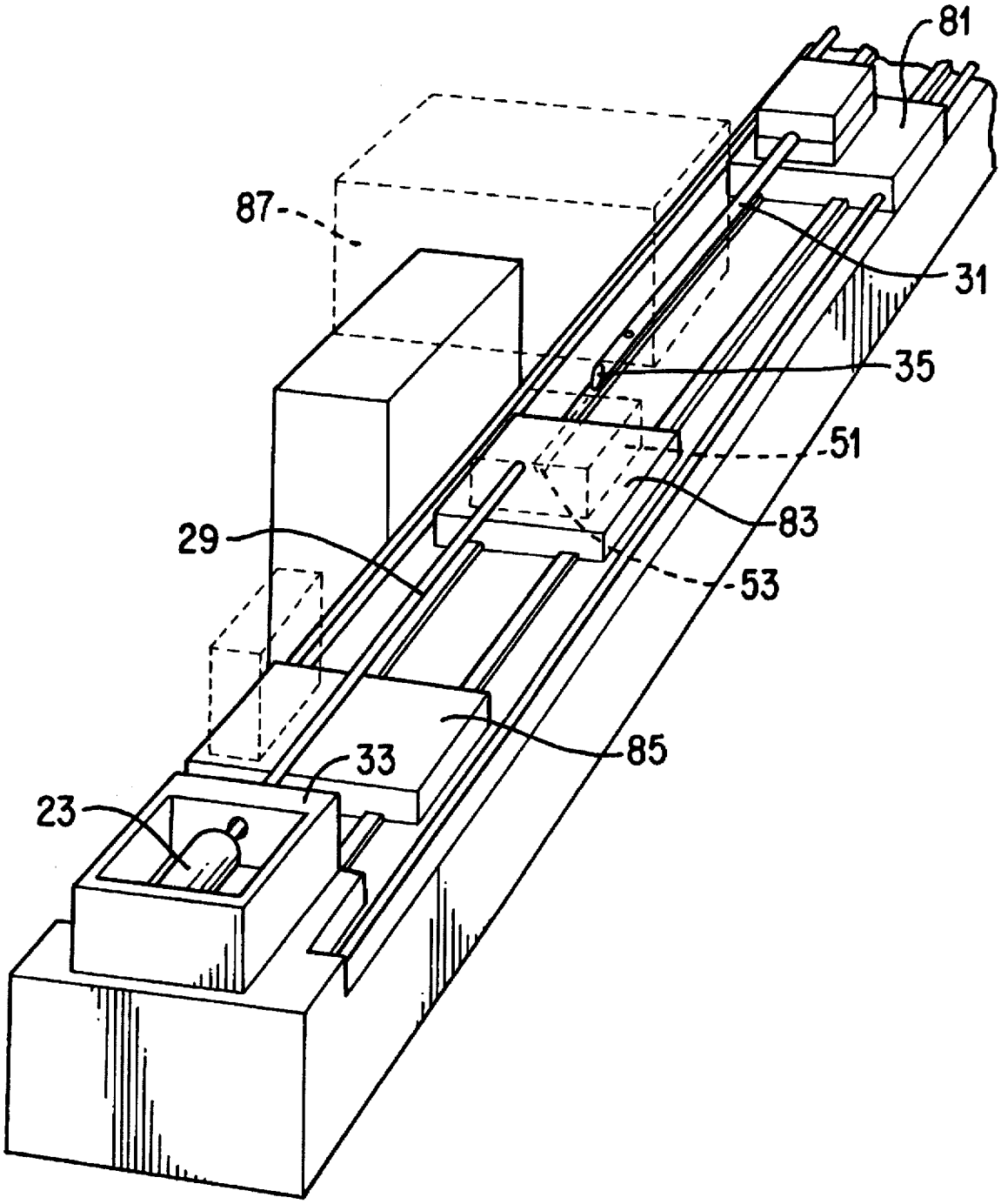
FIG. 6 is a schematic illustration of an apparatus for a burring processing method according to an embodiment of this invention.

A second embodiment of this invention, as shown in FIG. 6, uses as a jig a cylindrical bar-like steel ball striking member 31 having a curved inclined section 35 at its tip portion, and a rod bar 29 having the axis aligned with the axis of the steel ball striking member 31 is attached to a supporting pedestal 33 so as to be movable axially.

Figure 7:
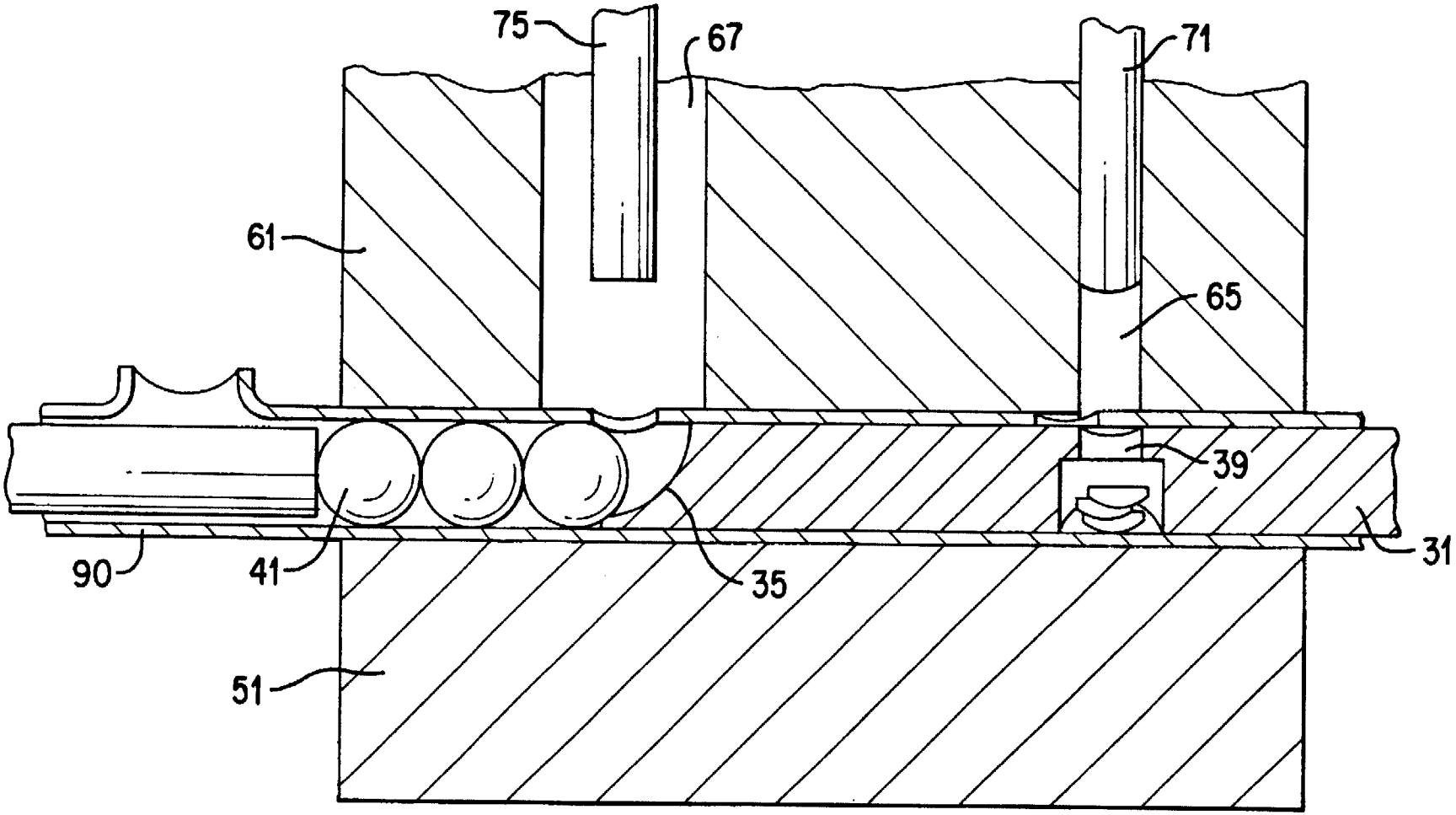
FIG. 7 is a cross-sectional view of a principal section available for describing a burring processing method according to another embodiment of this invention.
Figure 8:
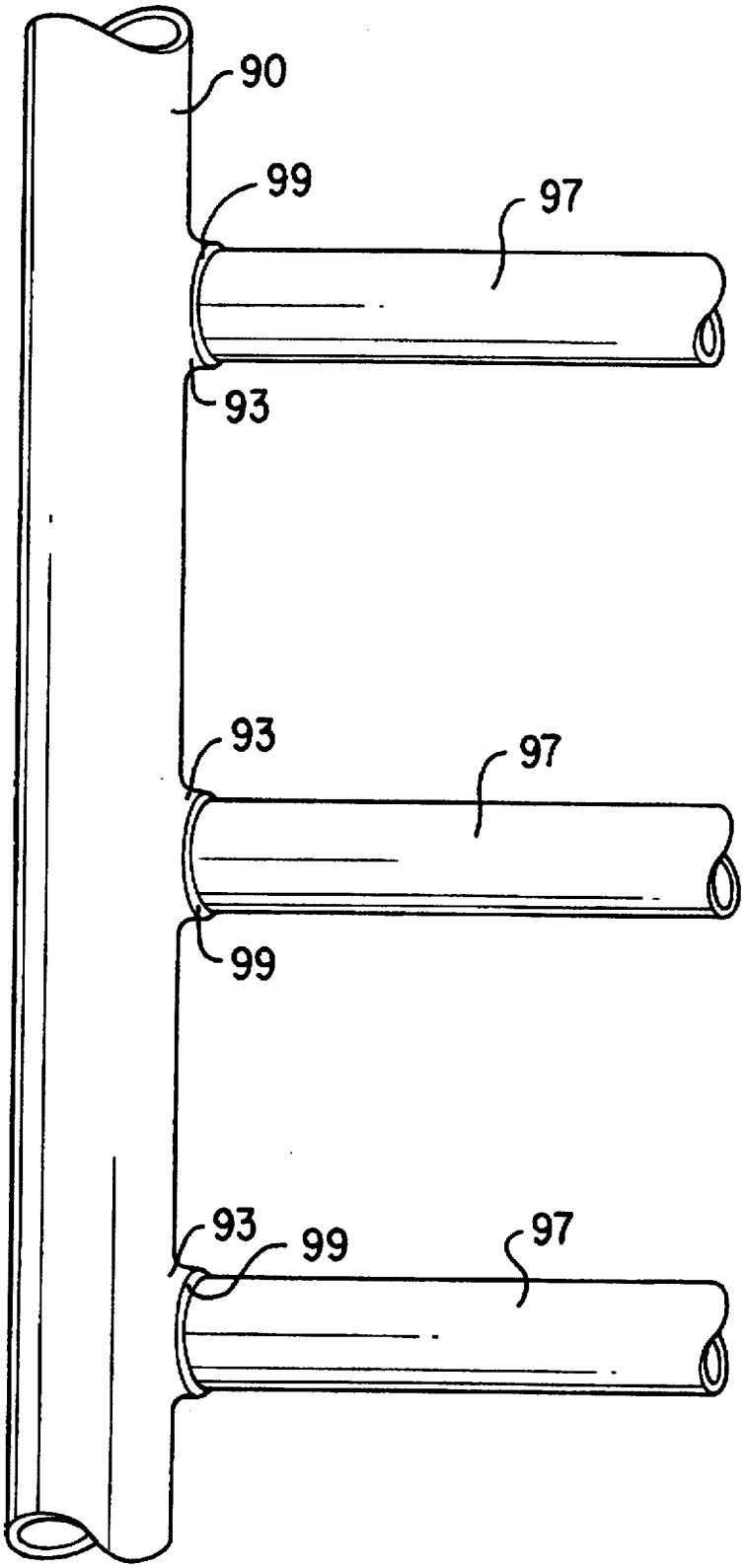
FIG. 8 illustrates the joining state between a metallic pipe and branch pipes.
Figure 9:
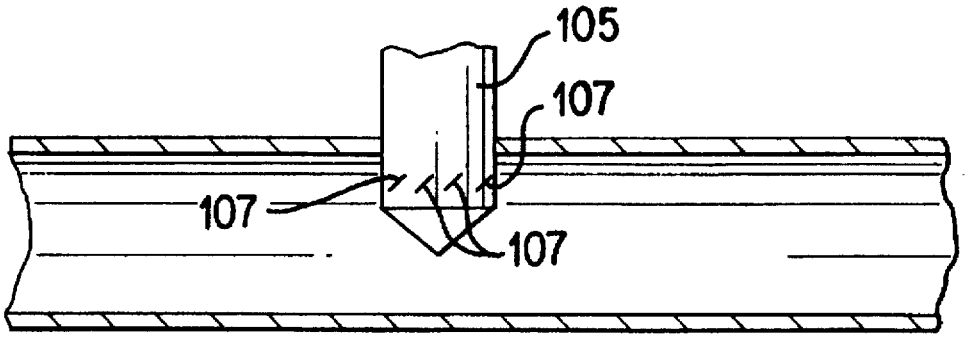
FIG. 9 is an illustration of an example of the prior burring processing.
Figure 10:
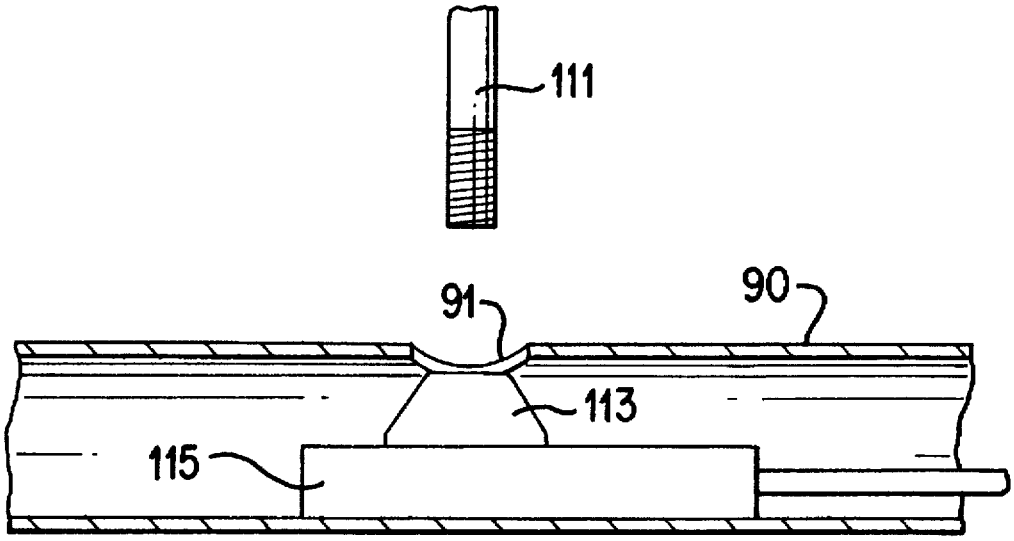
FIG. 10 is an illustration of another example of the prior burring processing.
Figure 11:
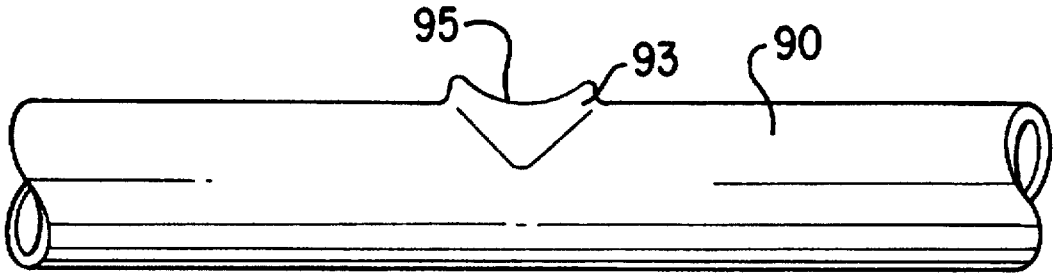
FIG. 11 is a side elevational view showing a metallic pipe subjected to the burring processing.

This steel ball striking member 31, as shown in FIG. 7, is composed of a steel bar whose outer diameter is generally equal to the inner diameter of a metallic pipe 90, and its tip portion serves as the inclined section 35 and a punching hole 39 having the axis perpendicular to the axis of the steel ball striking member 31 is formed at the vicinity of the tip portion thereof.

Further, the proximal portion of the steel ball striking member 31, as shown in FIG. 6, is fixed by a jig fixing pedestal 81 and the steel ball striking member 31 is made to be movable axially without shifting of the axis by means of the jig fixing pedestal 81.

Still further, the rod bar 29, being disposed so that its axis coincides with the axis of the steel ball striking member 31, is designed to be movable axially by means of a piston rod of a piston cylinder 23 fixedly secured to the supporting pedestal 33, and further a clamping pedestal 85 and a metal pattern fixing pedestal 83, which are parallel-movable in the directions of the axis of the rod bar 29, are disposed between the supporting pedestal 33 and the jig fixing pedestal 81, and a driving section fixing pedestal 87 is provided above the metal pattern fixing pedestal 83.

To the metal pattern fixing pedestal 83, there is fixed a lower pattern 51 having a lower pattern groove section 53 in its faying surface as shown in FIG. 4. As well as the first-mentioned embodiment, this lower pattern groove section 53 has a semi-cylindrical configuration corresponding to the outer diameter of the metallic pipe 90, and the central axis of the lower pattern groove section 53 is also aligned with the axes of the rod bar 29 and the steel ball striking member 31 and it is also placed at the tip portion of the rod bar 29.

In addition, an upper pattern 61 as shown in FIG. 4 is fixed to a movable plate to match the lower pattern 51.

A movable plate driving apparatus is mounted on the driving section fixing pedestal 87 and the punch 71 is disposed inside a punching through-hole 65 of the upper pattern 61, a steel ball returning pin 75 is disposed inside a guide hole 67, and a punch driving apparatus, a returning pin driving apparatus and others are situated on the driving section fixing pedestal 87.

Furthermore, in this second embodiment, the jig fixing pedestal 81 is retreated so that the tip portion of the steel ball striking member 31 is greatly separated from the rod bar 29, and the metallic pipe 90 is inserted to deeply cover the rod bar 29 and fixed by a clamp of the clamping pedestal 85.

In this state, when the jig fixing pedestal 81 is driven to advance so that the tip portion of the steel ball striking member 31 is inserted into the metallic pipe 90, a plurality of steel balls 41 are put in the inside of the metallic pipe 90 and the steel ball striking member 31 is inserted into the metallic pipe 90 and the position of the jig fixing pedestal 81 is adjusted so that the tip portion of the steel ball striking member 31 is positioned under the guide hole 67 of the upper pattern 61, and the punching hole 39 is set at the position of the punching through-hole 65.

More specifically, as well as the first embodiment, this second embodiment uses the lower pattern 51 having the semi-cylindrical groove section 53 in its faying surface and the upper pattern 61 also having the semi-cylindrical groove section 63 in its faying surface.

Also included therein are the rod bar 29 whose center axis is aligned with the center axis of the lower pattern groove section 53 of the lower pattern 51 and a jig, the tip portion of the jig being set at the position of the lower pattern groove section 53 of the lower pattern 51 so that the inclined section 35 of the steel ball striking member 31 is aligned with the guide hole 67 of the upper pattern 61 and the punching hole 39 of the steel ball striking member 31 is aligned with the punching through-hole 65.

Furthermore, the clamping pedestal 85 is moved to causes the metallic pipe 90 to move up to a given position, and the upper pattern 61 is lowered to fix the metallic pipe 90 and the hole 91 is made in the metallic pipe 90 by the punch 71, and subsequently the upper pattern 61 is lifted to permit the prepared hole 91 to be aligned with the guide hole 67, and the upper pattern 61 is again lowered to fix the metallic pipe 90. Then, the rod bar 29 is moved to advance, with the result that as well as the first embodiment the steel balls 41 can be pressed against the inside of the metallic pipe 90 at the position of the prepared hole 91.

At this time, the steel balls 41 receiving the pressing force from the rod bar 29 transfers most of the force from the rod bar 29 through the inclined section 35 at the tip portion of the jig to the prepared hole 91, while also transferring a portion of the force to a contact portion other than the position of the prepared hole 91 of the metallic pipe 90.

However, since the circumference of the metallic pipe 90 but the peripheral portions of the prepared hole 91 is held between the upper pattern 61 and the lower pattern 51, the portion around the prepared hole 91 of the metallic pipe 90 can be deformed by the pressing force of the rod bar 29 so as to surely form the overhanging section 93.

Moreover, in a case where the jig fixing pedestal 81, i.e., the steel ball striking member 31, is moved to accomplish the positional adjustment, or when the clamping pedestal 85 is moved to move the metallic pipe 90 to a given position, the manual positioning is possible, whereas extremely quick burring processing becomes possible if using an automatic control processing machine such as an NC processing machine.

Since this invention is concerned with a method in which a jig is inserted into the inside of the metallic pipe so that the inclined section is located under a prepared hole of a metal pipe, and the steel balls are pushed the inclined section inside the metallic pipe, the steel balls are pressed against the prepared hole from under the prepared hole through the inclined section whereby the force for bending up the peripheral section of the prepared hole can work on the metallic pipe with extreme ease so that the burring processing can easily be accomplished to protrude the peripheral section of the prepared hole to produce an overhanging section.

The operation involves only aligning the inclined section of the jig with the prepared hole and pressing the steel balls positioned inside the metallic pipe against the inclined section, and hence easy and quick burring processing becomes possible, and since the prepared hole is pushed and enlarged with the steel balls, a beautiful finish is realizable.

In addition, in the case that the jig with the punching hole and the inclined section is inserted into the metallic pipe to make the prepared hole by the punching processing and further to enlarge the prepared hole by means of the steel balls, there results in accomplishing the burring processing within an extremely short time.

Furthermore, in the case of using the jig in which the opening section for the rod hole is formed in a side surface of the core metal body and the rod bar coupled to the piston and the plurality of steel balls are formed, the burring processing can easily and quickly be carried out to enlarge the prepared hole in such a way that the jig is inserted into the metallic pipe so that the opening section is positioned at the prepared hole of the metallic pipe.

If using the jig having the punching hole arranged side by side with the opening section of the core metal body, the formation of the prepared hole is easily possible by the punching processing as well as the burring processing.

Still further, in the case of using the burring processing apparatus which includes the metal pattern having the groove sections in the faying surfaces and the upper pattern with the punching through-hole and the guide hole, the bar-like jig having the inclined section matching the guide hole and punching hole suiting the punching through-hole, the rod bar, the punch and the steel ball returning pin, the quick and easy burring processing is repeatedly possible in such a manner that the metallic pipe is disposed to cover the rod bar and the jig and the steel balls are housed inside the metallic pipe.

Moreover, if the burring processing apparatus is employed which uses the jig having the core metal body with the rod hole accommodating the rod bar and the steel balls, when the jig is covered with the metallic pipe, the steel balls, the rod bar and the inclined section can be set inside the metallic pipe, thus permitting the quick and easy burring processing.

It should be understood that the foregoing relates to only preferred embodiments of the present invention and is for illustrative purposes only but not limited thereto, and the scope of the invention is defined by the appended claims to cover all changes and modifications of the embodiments of the invention.

What is claimed is:

1. A burring processing method comprising the steps of:

inserting a jig with a punching hole and an inclined section into an inside of a metallic pipe, said jig having a columnar shape with a circular cross section substantially corresponding to an inner diameter of the metallic pipe;

driving a tip portion of a punch onto the metallic pipe at a portion above said punching hole of said jig to make a prepared hole in a side surface of said metallic pipe;

moving the metallic pipe such that the prepared hole is aligned with and located above the inclined section of the jig; and pressing a steel ball with a diameter greater than that of said prepared hole against said inclined section of said jig and pushing a periphery of the metallic pipe around the prepared hole by the steel ball from under said prepared hole toward an outside of said metallic pipe to enlarge the diameter of said prepared hole and to produce an overhanging section around the enlarged prepared hole.

2. A burring processing method as defined in claim 1, wherein said jig includes a metal body having a proximal end, a tip portion at a side opposite to the proximal end, a rod hole extending from the proximal end toward the inclined section near the tip portion, and a lateral opening arranged perpendicularly to the rod hole and communicating with the rod hole through the inclined section, said punching hole being formed between the inclined section and the tip portion; and a rod bar slidably situated in the rod hole, said rod bar, when being pushed, pressing the steel ball in the rod hole to exit from the lateral opening through the inclined section to thereby bend the periphery of the metallic pipe around the prepared hole.

3. A jig for burring processing comprising:

a core metal body having an elongated cylindrical rod-like configuration with an outer diameter substantially corresponding to an inner diameter of a metallic pipe to be processed and having therein a rod hole which linearly extends to establish an opening in a proximal side end portion of said core metal body while being curved at a vicinity of a tip portion of said core metal body, and an opening in a side surface of the core metal body communicating with the rod hole;

a punching hole situated between the opening in the side surface and a tip end of the core metal body, said punching hole and the opening in the side surface being situated side by side and extending perpendicularly to an axis of the core metal body;

a rod bar and a piston disposed near said proximal portion of said core metal body, said rod bar being connected to the piston and placed within said rod hole; and a plurality of steel balls housed within said rod hole to be positioned at a tip portion of said rod bar, said steel balls, when the rod bar is moved toward the tip end by the piston, being pushed to exit through the opening in the side surface of the core metal body to thereby produce an overhanging portion to the metallic pipe.

4. A jig for burring processing as defined in claim 3, further comprising a pedestal fixed to the proximal portion of the core metal body and the piston so that when the piston is actuated, the rod bar moves in the rod hole of the core metal body to push the steel balls.

5. A burring processing apparatus comprising:

a metal pattern including a fixed lower pattern and a movable upper pattern, said lower pattern having a semi-cylindrical groove section suiting the outer diameter of a metallic pipe which is made in a surface facing the upper pattern and said upper pattern having a semi-cylindrical groove section matching the same metallic pipe which is made in a surface facing the lower pattern, and said upper pattern having a punching through-hole extending from said upper pattern groove section to a top surface of said upper pattern and further having a guide hole similarly penetrating said upper pattern with a diameter larger than that of said punching through-hole;

a cylindrical bar-like jig fitting the inner diameter of said metallic pipe, and having a tip portion disposed inside said upper and lower pattern groove sections, an inclined section positioned under said guide hole and a punching hole positioned under said punching through-hole;

a rod bar with a piston and a cylinder, said rod bar being movable forward and backward by a combination of the piston and the cylinder and provided so that its axis is aligned with an axis of said jig;

a punch slidably situated in said punching through-hole of said upper pattern; and a steel ball returning pin located within said guide hole of said upper pattern and movable up and down.

6. A burring processing apparatus as defined in claim 5, wherein said cylindrical bar-like jig includes:

a core metal body having a rod hole which linearly extends to establish an opening in a proximal side end portion of said core metal body, the inclined section at a vicinity of a tip portion of said core metal body and an opening in a side surface of said core metal body extending from the rod hole through the inclined section, said rod bar being positioned in the rod hole;

a plurality of steel balls housed within said rod hole and positioned at a tip portion of said rod bar; and a punching hole formed between the opening in the side surface and a tip end of said core metal body to be arranged side by side with said opening in the side surface so that its axis is perpendicular to an axis of said core metal body.

7. A burring processing apparatus as defined in claim 5, wherein said jig includes the inclined section at the tip portion and the punching hole near the inclined section and has a linear shape, the inclined section facing a tip end of he rod bar.

8. A burring processing apparatus as defined in claim 7, further comprising a plurality of steel balls situated between the jig and the rod bar.

* * * * *